US007614254B2

(12) United States Patent
Weihing

(10) Patent No.: US 7,614,254 B2
(45) Date of Patent: Nov. 10, 2009

(54) COMPONENT PLACEMENT SET FOR THE ASSEMBLY OF A GIVEN NUMBER OF SYSTEM COMPONENTS OF A KNITTING MACHINE

(75) Inventor: Frank Weihing, Gomaringen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/889,442

(22) Filed: Aug. 13, 2007

(65) Prior Publication Data

US 2008/0034803 A1 Feb. 14, 2008

(30) Foreign Application Priority Data

Aug. 11, 2006 (EP) ..... 06016766

(51) Int. Cl.
*D04B 35/02* (2006.01)

(52) U.S. Cl. ..... 66/1 R; 66/116

(58) Field of Classification Search ..... 66/1 R, 66/116; 206/380, 382
See application file for complete search history.

(56) References Cited

U.S. PATENT DOCUMENTS 2,944,662 A 7/1960 Colton
3,004,660 A * 10/1961 Hofmann ..... 206/382
3,452,859 A * 7/1969 Hofmann ..... 206/380
5,366,083 A * 11/1994 Sos et al. ..... 206/380
6,155,080 A * 12/2000 Yamaguchi et al. ..... 66/1 R
6,912,875 B2 * 7/2005 Fehrenbacher ..... 66/1 R
7,070,050 B2 * 7/2006 Faller et al. ..... 206/380

FOREIGN PATENT DOCUMENTS

| | | |
|---|---|---|
| BE | 570468 | 8/1958 |
| DE | 203 19 108 U1 | 3/2004 |
| DE | 203 19 782 U1 | 4/2004 |
| GB | 1186392 | 4/1967 |
| KR | 2003-0064507 | 8/2003 |

* cited by examiner

*Primary Examiner*—Danny Worrell
(74) *Attorney, Agent, or Firm*—Fitch, Even, Tabin & Flannery; Norman N. Kunitz

(57) ABSTRACT

The component placement set in accordance with the invention for equipping a knitting machine consists of the system components that are required for equipping the knitting machine, said system components being sorted according to type and arranged in one package in different chambers. The chambers are closed all around and protect the packaged system components against environmental influences and against loss. Preferably, the package can be opened only by destroying it, in which case the chambers of the package can be cut open independently of each other. The order of the system components in the individual chambers preferably corresponds to the order in which they are to be placed in the knitting machine. This applies, in particular, to system components having different foot positions.

17 Claims, 4 Drawing Sheets

COMPONENT PLACEMENT SET FOR THE ASSEMBLY OF A GIVEN NUMBER OF SYSTEM COMPONENTS OF A KNITTING MACHINE

CROSS REFERENCE TO RELATED APPLICATION

This application claims the priority of European Patent Application No 06 016 766.5, filed on Aug. 11, 2006, the subject matter of which, in its entirety, is incorporated herein by reference.

BACKGROUND OF THE INVENTION

As a rule, circular knitting machines comprise system component supports in the form of a knitting cylinder and a rib dial that are to be equipped with system components which, together, form a set of stitch-forming system components that is also referred to as a tool set. A tool set may comprise, for example, a machine knitting needle and a sinker. Technicians who concern themselves with the component placement and, optionally, the set-up of a knitting machine obtain an adequate number of system components of the tool set in preparation for their work, place such system components within reach and insert them in the appropriate slits of the knitting cylinder or the rib dial. In the case of large circular knitting machines, the knitting cylinder may have more than 5,000 needle channels. The same is true of rib dials or of a sinker support ring.

In the case of circular knitting machines that are designed for knitting patterns, the tool sets include additional system components which are referred to as selection components, for example. Depending on the pattern and on the position of the machine knitting needle in the needle bed, the selection components may have feet at different locations. Selection components having different foot positions must be installed in the pre-specified sequence in the system component support, which requires considerable attention on the part of a technician.

A wrongly equipped knitting machine cannot be started up. Therefore, equipping must be done with extreme care, thus representing a time-consuming process.

It is the object of the invention to reduce the time required for setting up and equipping the knitting machine.

SUMMARY OF THE INVENTION

This object is achieved with the component placement set in accordance with the invention. The component placement set consists of a package having a minimum of two chambers. The first chamber preferably contains the layed out required number of system components of a first type. The second chamber contains the layed out system components of a second type (and, optionally, additional system components), again in the required number. The number of tool sets corresponds to the number required for the complete equipment of the knitting machine. Consequently, the component placement set in accordance with the invention makes available to technicians all the system components required for equipping the knitting machine, whereby a technician will find the system components in a pre-sorted manner. In so doing, all the system components belonging to the tool sets, such as, for example, sinkers, intermediate sliders, coupling elements, selection elements, rehanging bars, needles, etc., which are required for equipping a circular knitting machine, are provided packaged in the correct number and in the sequence required for assembly. The needles or other system components need not be counted during the assembly of the knitting cylinder and/or the rib dial. Different types of system components, such as, for example, needles, selection bars, sinkers, etc., can be removed individually from the package, without the component systems of other types detaching from the package. This is particularly advantageous when system components of different types must be installed in sequence in the knitting machine.

The component placement set in accordance with the invention comprises—at least in a preferred embodiment—the system components of the tool set in the exact number and in the sequence in which they are required for placement in the knitting machine. For example, the long-butt needles or miscellaneous long-butt parts are packaged in the exact number of pieces and sequence in which they are placed in the machine. The same applies to the short-butt needles or miscellaneous short-butt parts. In addition, the inventive component placement set may comprise a lower number of system components intended for replacement. These replacement parts are preferably separate from the number of system components that are required for equipping the knitting machine. The replacement parts need not be arranged in a specific order.

In view of the assembly-specific packaging, the time required for the installation of the needles and other system components can be considerably reduced. It is no longer necessary to individually remove different types of system components from boxes and bags. Furthermore, the respective number of systems components for equipping the knitting cylinder or the rib dial need not be counted, because the system components are made available in the required number of pieces. The user only needs to order a component placement set of the correct type, but not several different individual components.

System components of one type, however, with different foot positions can be packaged in one and the same chamber. For example, this applies to selection components for use in knitting machines featuring a single-component selection or to needles which are installed in knitting machines with several cam paths. These system components having different foot positions are lined up next to each other, in which case the system components with different foot positions are preferably arranged exactly in that order in the package in which they are also to be installed in the knitting machine. For example, referring to selection components with sixteen different positions, these components are packaged—diagonally next to each other—from the first to the sixteenth foot.

Until now, the system components of a tool set have been packaged in different quantities in boxes and pouches. Depending on type, between 20 and 250 system components are packaged per pouch. Each box contains several pouches. Consequently, in the usual case, a box contains between 100 and 2,000 system components. In the course of the assembly of the system components of one tool set, these components must be taken out of the boxes and pouches, and, in addition, the system components must frequently be layed out and arranged in sequence in order to be able to place them in the machines. Considering system components with alternating foot positions, e.g., selection components or needles used in multi-path machines, the system components or needles must additionally be brought in the appropriate diagonal sequence, which is very time-consuming.

The component placement set in accordance with the invention preferably comprises system components for the knitting cylinder, as well as system components for the rib dial. The component placement set may also be set up for circular knitting machines without rib dial, as well as for knitting machines with several knitting cylinders or rib dials. The component placement sets are unambiguously associated with the knitting machines. Therefore, there is no risk of placing a wrong order.

For example, the component placement set may be provided as a plastic film package. In that case, the chambers consist of pockets which can be opened independently of each other. Preferably, the chambers are sealed. When the chambers are opened, the plastic film package is destroyed. The chambers cannot be resealed. Sealing devices, such as, for example, molded strip closures can be omitted. The pouches are opened by pulling away the plastic films. Preferably, each chamber is provided with its own separate plastic film, so that the chambers can be opened independently of each other. The different system components, such as, for example, needles, selection components, sinker, can be individually removed from the package, without having system components of other types fall out of the package. For example, this is achieved by opening the pouches of the packages—one after the other—by pulling away the plastic films, namely, in the order in which the system components are needed.

The plastic film package may consist of an upper and a lower plastic film which are joined to each other, for example, welded to each other, in order to form chambers between them. For stability reasons, the lower plastic film can comprise a cardboard or another stable support. This lower plastic film or substrate represents part of the component placement set and represents its support. Preferably, the upper and the lower plastic film are welded to each other along straight parallel seams. As a result of this, each longitudinally configured chamber extends along the entire length of the package, whereby said chambers are arranged next to, and parallel to, each other. It is also possible for a chamber to extend along the entire length of the package, divided into several—at least two—sections. This is the case, when several different system components are made available separately for placement reasons. Consequently, when the packages are filled, the system components sealed in the plastic film can be clearly presented.

The lower plastic film that is configured as a stable support may consist of several sections. One section may then have the size of one individual chamber. In order to be able to fold or collapse the component placement set, free spaces may be provided between the individual sections. These free spaces are connected to each other and held together by bendable connecting means, e.g., in the form of plastic films. These additional connecting means are different from the aforementioned plastic films, which, together with the support, form the chambers or pockets. The connecting means may be provided on the underside of the support or on the upper side of the support, or be alternated.

Additional details of advantageous embodiments in accordance with the invention are the subject matter of the description hereinafter, of the drawings or of the claims.

BRIEF DESCRIPTION OF THE DRAWINGS

The drawings are used to illustrate the invention. They show in

DETAILED DESCRIPTION OF THE INVENTION

Figure 1:
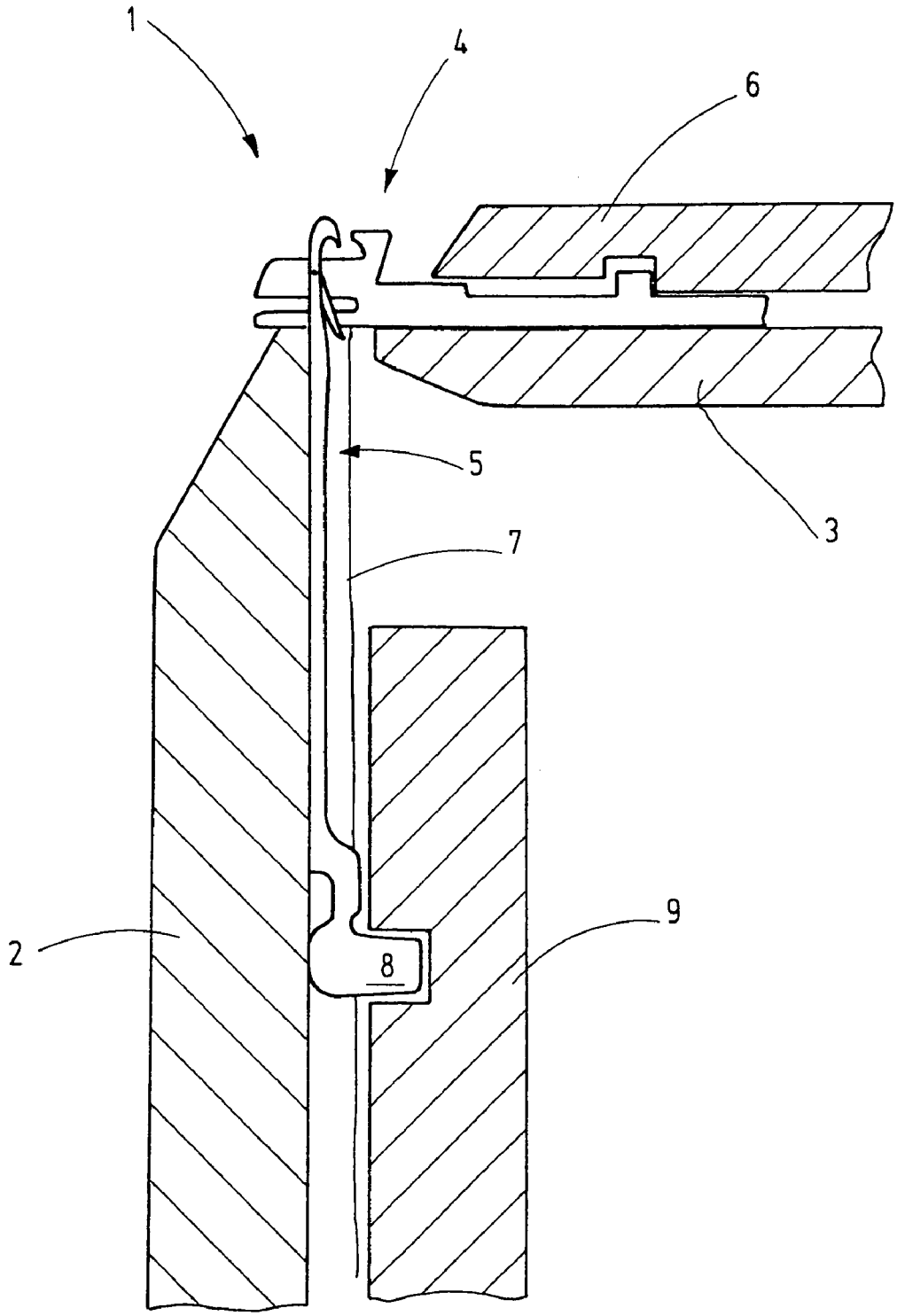
FIG. 1 a detail of a highly schematic knitting cylinder and a rib dial with system components of a tool set.

FIG. 1 shows a tool set 1 of a knitting machine that is only shown in a rudimentary manner with reference to a detail of a knitting cylinder and, likewise, to a detail of the shown rib dial 3. For illustration purposes, the tool set 1 consists only of a sinker 4 and a latch-type needle 5. The sinker 4 is supported in a channel of the rib dial 3 so that said sinker can be shifted in radial direction. For the shifting operation, a cam disk is provided in the cam 6. The rib dial 3 has a large number of radially oriented slits for the accommodation of such sinkers 4, whereby each belongs to a tool set.

The knitting cylinder 2 has a large number of slit-like needle channels 7, with latch-type needles 5 seated in each of said channels. The foot 8 of said needles is in engagement with a cam 9. If the knitting cylinder and the cam 9 are rotated relative to each other, the feet 8 of the latch-type needle 5 follow the cam path and are thus moved up and down in axial direction as in FIG. 1.

As a result of the synchronized back-and-forth movement of the sinker 4 and the latch-type needle 5, said movement being caused by the rotation of the needle cylinder 2 or of the rib dial 3, the stitch-forming operation is carried out.

Figure 2:
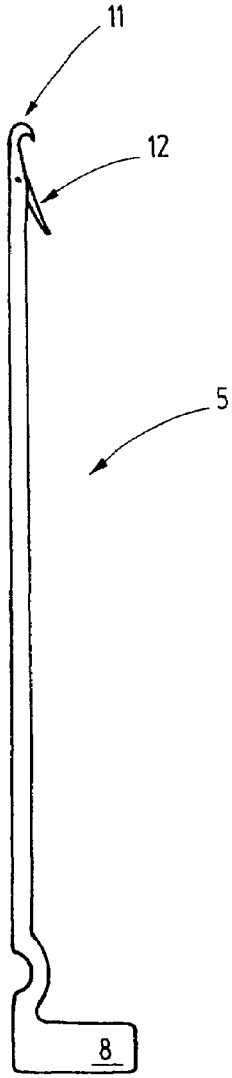
FIGS. 2 through 5 a schematic side view of various system components of a tool set.

FIG. 2 again shows the latch-type needle 5 in an embodiment as a long-butt needle with a long foot 8. The exemplary embodiment shows the foot 8 arranged on the end opposite its hook 11. However, said foot may also be arranged in a different position. The latch-type needle 5 has a pivotally supported tongue 12. However, it is also possible to consider slider needles, rehanging needles or other needles as the knitting tool or as a part of the tool set.

Figure 3:
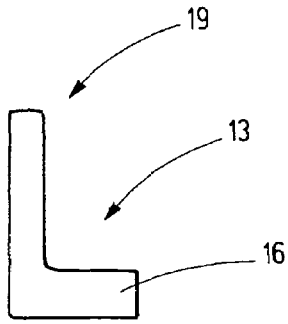
Figure 4:
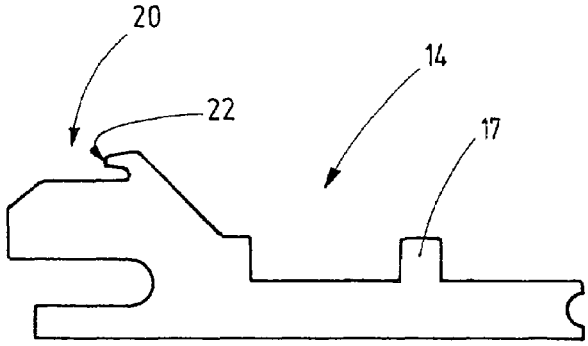
Figure 5:
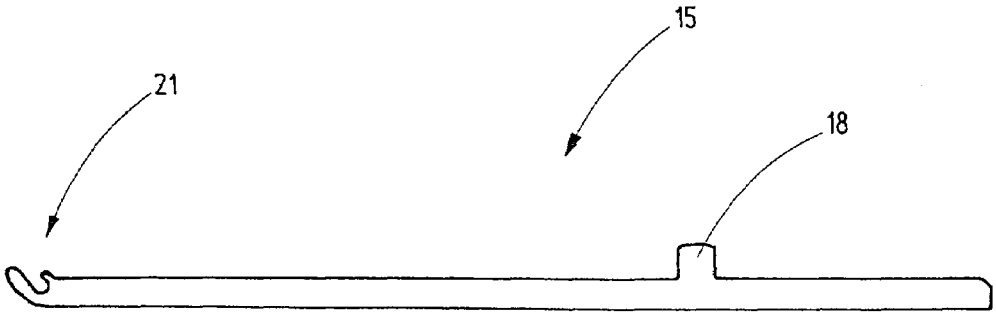

FIGS. 3 through 5 show various types of intermediate sliders 13, sinkers 14, rehanging components 15, each of which, like the latch-type needle 5, may be a component of a stitch-forming tool set. They may have feet 16, 17, 18 and each is disposed to be moved in longitudinal direction in a corresponding channel. Thus, each of the system components 5, 13, 14, 15 has a foot, as well as a body, which is set up in a system component support for the longitudinally movable support. In addition, each of the system components 5, 13, 14, 15 comprises a functional section, which, in the case of the latch-type needle 5, consists of the hook 11 and the tongue 12. In the case of the sinkers 13, 14, 15, the functional section consists of an appropriately contoured end 19, 20, 21, which, during the stitch-forming process, takes over a function assigned to it. Referring to the sinker 14 and the end 20, this function may be, for example, shooting-in a stitch, for which purpose an appropriate nose-shaped projection 22 is provided.

Figure 6:
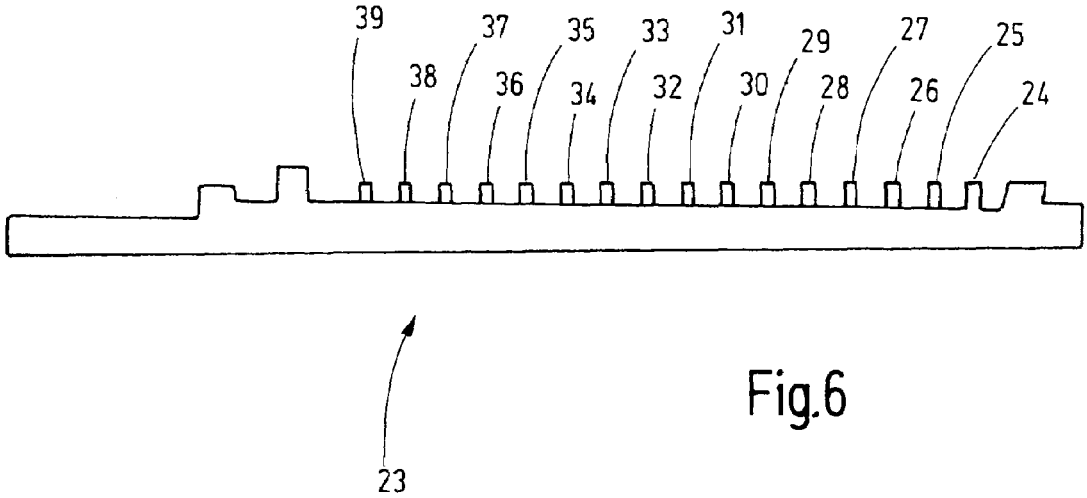
FIG. 6 a side view of a block selection component of a tool set.
Figure 7:
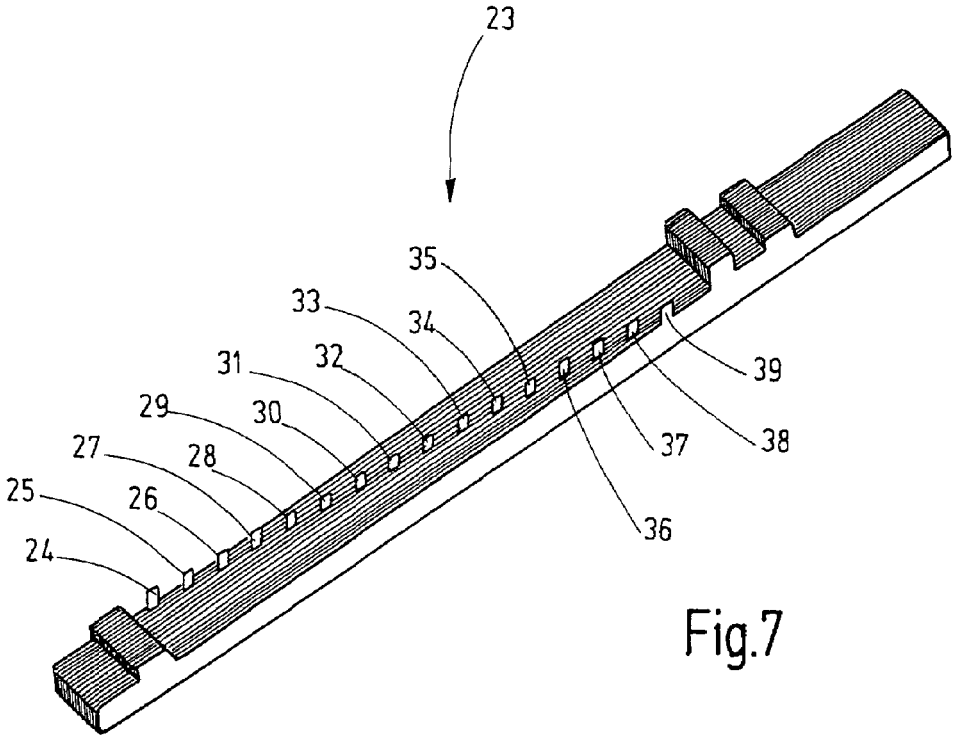
FIG. 7 a perspective view of the selection components in accordance with FIG. 6; and, FIG. 8 the component placement set with various system components of a tool set.

Referring to pattern-producing knitting machines, selection components 23 as shown by FIGS. 6 and 7 are frequently required. Each of the two Figures shows a larger number of the selection components 23 arranged block-like—flat side to flat side—next to each other.

The selection components 23 are identical to each other, apart from the position of their respective feet 24 through 39. The feet 24 through 39 of the shown sixteen selection components 23 are located in different axial positions. Each selection component has a flat part that can be arranged in a needle channel so as to be movable in longitudinal direction.

The selection components 23 must be placed in the knitting cylinder in a specific order. FIG. 7 shows such an arrangement. In so doing, the feet 24 through 39 are located on a straight line extending diagonally across the block.

Figure 8:
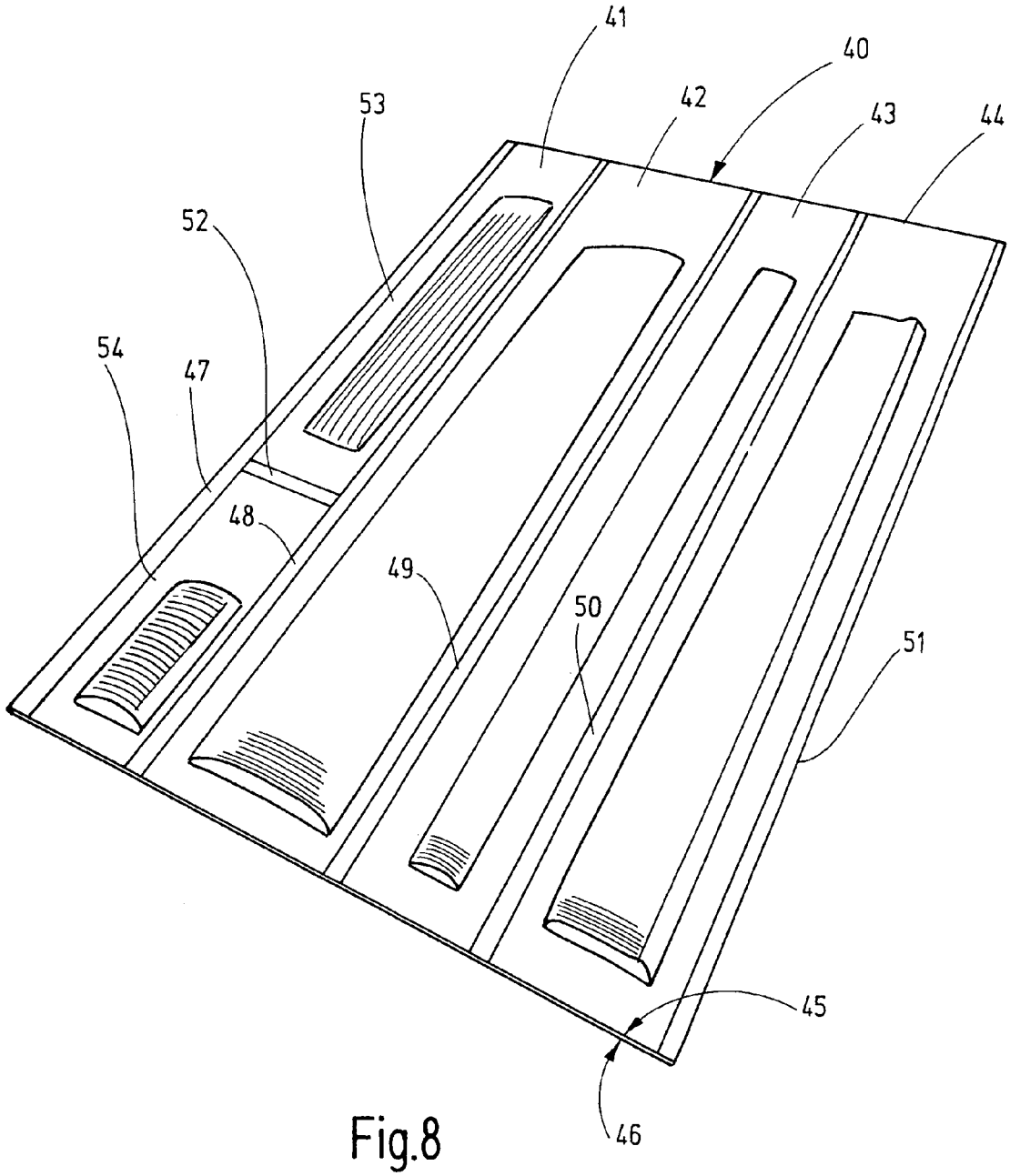

The components belonging to a tool set, for example, the components 5, 13, 14, 15, 23, are counted and combined in a component placement set 40, as shown by FIG. 8. Depending on the configuration of the knitting machine, it may happen that a tool set consists of only one sinker and one needle. Likewise, it may happen, that a tool set consists of several sinkers and of one needle, or of several needles and several sinkers, or of several needles and no sinkers. Consequently, the number of system components 5, 13, 14, 15, 23 does not necessarily correspond to the number of tool sets. The number of system components may be an integral multiple or an integral fraction of the number of the tool sets. FIGS. 2 through 5, as well as 6 and 7, respectively, show one system component (5, 13, 14, 15, 23) of one type.

The component placement set 40 comprises respectively the same system components of one and the same type in different chambers 41, 42, 43, 44. In so doing, the same system components may have the same foot height (long-butt and short-butt components) or have the same foot positions. The chambers 41, 42, 43, 44 are formed by pockets which are defined between flat, superimposed plastic films 45, 46 and form a package. In so doing, the plastic film 46 comprises a reinforcing support, e.g., cardboard. In each case, the pockets are formed between welded seams 47, 48, 49, 50, 51 that extend parallel to each other along the entire length of the component placement set 40. Each pocket or chamber 41 through 44 holds the system components of one type required for the complete equipment of the knitting machine. In so doing, the system components are arranged side by side in an ordered manner. As is obvious from the example of FIG. 7, their order corresponds to the sequence required in the knitting machine. As is further shown by FIG. 8, in exceptional cases, individual chambers may also contain system components of a different type. This is potentially possible, e.g., in the case of system components that are relatively small or are required only in small numbers. As shown by FIG. 8, these system components are preferably arranged at a distance from each other in the chamber 41. To achieve this, the chamber 41 may be divided into two sections 53 and 54, e.g., along a dividing line. The division can be achieved by inlays, welding or cementing spots or strips, or it may also be achieved in that the sections 53 and 54 have separate or spaced-apart plastic film sections. Should the placement in a knitting machine require this, a chamber 41, 42, 43, 44 may comprise more than two sections. Depending on the equipment requirements, it is also possible for different system components to be arranged in one chamber 41, 42, 43, 44. For example, the system components are arranged perpendicular to the welding seams 47, 48.

The chambers 41, 42, 43, 44 are preferably under vacuum, so that the plastic films 45, 46 cling tightly to the packaged system components. In addition, the chambers 41, 42, 43, 44 may be filled with a corrosion-controlling oil, or at least traces of an oil, or with another suitable substance.

The plastic film 45 is preferably a film of a transparent plastic material. The plastic film 46 comprises a stabilizing support, preferably cardboard. Both are—not illustrated in detail—welded to each other on their front ends in a direction transverse to the welding seams 47, 48, 49, 50 in order to hermetically seal all chambers 41, 42, 43, 44 with respect to the outside. Advantageously, the plastic film 45 is larger than the support 46, so that the plastic film 45 can be easily stripped off the support 46.

The plastic film 45 is stripped. To do so, the technician first opens that chamber 41, 42, 43, 44, in which the system components to be placed in the machined first are packaged. Once these system components are used up, the technician opens the next pocket in that he/she strips the plastic film 45 in order to remove the next set of system components and to place them in the knitting machine.

In the manner described here, it is possible to continue equipping the knitting machine until all the system components are used up. If a single system component remains, a placement error has occurred, because the system components are packaged in exactly the required number. If the technician has removed the system components in the prespecified sequence from the chambers and placed said components in the machine, the correct system component allocation does in fact exist. This applies, in particular, to the selection components 23 in accordance with FIGS. 6 and 7, or to the needles having different foot positions for placement in circular knitting machines having multiple cam paths.

The component placement set in accordance with the invention for equipping a knitting machine consists of the system components that are required for equipping the knitting machine, said system components being sorted according to type and arranged in one package in different chambers. The chambers are closed all around and protect the packaged system components against environmental influences and against loss. Preferably, the package can be opened only by destroying it, in which case the chambers of the package can be opened independently of each other. The order of the system components in the individual chambers preferably corresponds to the order in which they are to be placed in the knitting machine. This applies, in particular, to system components having different foot positions.

LIST OF REFERENCE NUMBERS

1 Tool set
2 Knitting cylinder, system component support
3 Rib dial, system component support
4 Sinker
5 Latch-type needle
6 Cam
7 Needle channel
8 Foot
9 Cam
10
11 Hook
12 Tongue
13 Sinker, intermediate slider
14 Sinker
15 Sinker, rehanging component
16 Foot
17 Foot
18 Foot
19 Ende
20 Ende
21 Ende
22 Projection
23 Selection components
24 Foot
25 Foot
26 Foot
27 Foot
28 Foot
29 Foot
30 Foot
31 Foot
32 Foot
33 Foot

34 Foot
35 Foot
36 Foot
37 Foot
38 Foot
39 Foot
40 Component placement set
41 Chamber
42 Chamber
43 Chamber
44 Chamber
45 Plastic film, package
46 Plastic film, package, cardboard
47 Welding seam
48 Welding seam
49 Welding seam
50 Welding seam
51 Welding seam
52 Dividing line
53, 54 Section

The invention claimed is:

1. Component placement set for placing a given number of tool sets, each including at least first and second different types of knitting system components, in a knitting machine, comprising; a plurality of said tool sets of a quantity corresponding to the given number of tool sets required to completely equip an identified type knitting machine; a plastic film package formed of an upper and a lower plastic film, which are welded to each other in order to form at least a first chamber and a second chamber between the upper and lower sheets; and wherein the first chamber contains system components of a first type in a number required for equipping the identified type knitting machine with the given number of tool sets, and the second chamber contains system components of a second type in a number required for equipping the knitting machine with the given number of tool sets.

2. Component placement set in accordance with claim 1, wherein the package comprises at least one additional chamber which contains system components of a third type in a number required for equipping the knitting machine with the given number of tool sets.

3. Component placement set in accordance with claim 1, wherein the system components, in at least one of the chambers, are arranged in the sequence in which they are to be installed in the knitting machine.

4. Component placement set in accordance with claim 1, wherein the system components of the first type are associated with a first system component support of the knitting machine.

5. Component placement set in accordance with claim 4, wherein the first system component support is a knitting cylinder.

6. Component placement set in accordance with claim 1, wherein the system components of the second type are associated with a second system component support of the knitting machine.

7. Component placement set in accordance with claim 6, wherein the second component support is a rib dial.

8. Component placement set in accordance with claim 1, wherein the system components of the first type are knitting machine needles.

9. Component placement set in accordance with claim 1, wherein the system components of the second type are holding-down sinkers.

10. Component placement set in accordance with claim 2, wherein the system components of the third type are selection components.

11. Component placement set in accordance with claim 1, wherein the chambers are pockets formed in the plastic film package such that said pockets can be opened independently of each other.

12. Component placement set in accordance with claim 1 wherein the upper and the lower plastic films are welded to each other along straight parallel seams, whereby each of the chambers extends along the entire length of the package, whereby said length is to be measured along the welded seams.

13. Component placement set in accordance with claim 1 wherein the plastic film is transparent.

14. Component placement set in accordance with claim 1, wherein all the chambers have a longitudinal configuration and are arranged parallel to each other.

15. Component placement set in accordance with claim 12, wherein at least one of the chambers is divided into sections by a welded seam extending transverse to the length direction, and contains different type system components.

16. Component placement set in accordance with claim 1, wherein the upper plastic film is larger than the lower plastic film.

17. Component placement set in accordance with claim 1, wherein the chambers contain different numbers of the system components.

* * * * *